US005292154A

United States Patent [19]

Williams

[11] Patent Number: 5,292,154

[45] Date of Patent: Mar. 8, 1994

[54] METHOD AND MATERIALS FOR CALENDAR FABRICATION RENEWAL

[76] Inventor: Larry M. Williams, 440 Dixon Landing Rd. #C-101, Milpitas, Calif. 95035

[21] Appl. No.: 75,013

[22] Filed: Jun. 9, 1993

Related U.S. Application Data

[63] Continuation of Ser. No. 803,132, Dec. 5, 1991.

[51] Int. Cl.[5] ..... B42D 5/04

[52] U.S. Cl. ..... 283/2; 40/107

[58] Field of Search ..... 283/2, 4; 40/107, 121

[56] References Cited

U.S. PATENT DOCUMENTS

| | | | |
|---|---|---|---|
| 443,894 | 12/1890 | Blackmer | 283/2 |
| 2,582,355 | 1/1952 | Ratner | 283/2 |
| 2,588,795 | 3/1952 | Bauer | 283/2 |
| 2,831,279 | 4/1958 | Esslinger | 40/119 |
| 3,464,200 | 9/1969 | Merrick | 58/58 |
| 4,757,624 | 7/1988 | Holec | 40/119 |
| 4,902,042 | 2/1990 | Rassi | 283/2 |

*Primary Examiner*—Mark Rosenbaum
*Assistant Examiner*—Willmon Fridie, Jr.

[57] ABSTRACT

Unexpired pictorial calendars are produced by adherently attaching calendar stickers (8) to bound pages (16). The pages (16) are printed with artwork (18). The artwork (18) is viewed with the calendar information (12) printed on the calendar stickers (8). The calendar stickers (8) have an adhesive (14) for attachment to the pages (16). Expired pictorial calendars can be renewed for future use by covering expired calendar information with the calendar stickers (8). Also, bound artwork from any source can be converted into a pictorial calendar.

4 Claims, 4 Drawing Sheets

METHOD AND MATERIALS FOR CALENDAR FABRICATION RENEWAL

This is a continuation of application Ser. No. 07/803,132, filed Dec. 5, 1991.

FIELD OF INVENTION

This invention relates to calendars, specifically to fabrication and renewal of calendars that display artwork with calendar information.

BACKGROUND: DESCRIPTION OF PRIOR ART

Pictorial calendars show photographs or other artwork with calendar information. A typical format for such calendars is to display a photograph with calendar information for each month of the year. A one year calendar may have 12 photographs for the 12 months of the year. Of course, a single photograph or multiple photographs can be displayed with each month, multiple months, or fractional months. Artwork for pictorial calendars is selected to be entertaining, informative, or aesthetically pleasing. The term artwork is defined to include photographs, drawings, printed text and any other printed matter that is desired for display with calendar information.

Generally, the artwork is of excellent quality. Some calendar owners like the artwork so much that they save their old pictorial calendars. However, most pictorial calendars are thrown away upon expiration of the calendar information. This is done even though the artwork may still be in good condition and results in needless waste production. The waste problem is significant since tens of millions of pictorial calendars are published annually. Inks in the artwork exacerbate the paper recycling problem: the paper must be de-inked before recycling.

Calendar companies tend to think of their products as being completely disposable. The calendar companies select captivating artwork. The customers are expected to view each item of artwork for one month. Then, at year end, the customers are expected to throw the pictorial calendars away and buy new ones. This is ironic. The artwork in some calendars are reproductions of great paintings or other things of beauty, yet calendar companies seem to believe that the appeal of the artwork is lost after one month of viewing. Furthermore, pictorial calendars are expensive.

Allowing the use of the artwork in pictorial calendars to be limited by the calendar information is illogical. Usually, the cost of printing the artwork is greater than the cost of printing the calendar information. So, why let the calendar information limit the use of the artwork? The answer is: no one has devised a practical way to reuse the artwork with updated calendar information. The disclosed invention provides a solution to this problem. Specifically, the present invention allows production of updated pictorial calendars from expired pictorial calendars or from any other bound artwork.

Although methods of reusing the artwork as pictorial calendars have been unavailable, there are alternative uses for the artwork. Rassi in 1990 U.S. Pat. No. 4,902,042 reviews methods of using calendar artwork after expiration of the calendar information. Calendars exist for which the artwork can be detached and used as postcards as in 1988 U.S. Pat. No. 4,757,624 to Holec. Some calendars are made to be used as picture books or handbooks after expiration of the calendar information, as in Rassi 1990 U.S. Pat. No. 4,902,042 and Esslinger 1958 U.S. Pat. No. 2,831,279. Alternatively, calendar bindings can be removed and the artwork displayed as simply artwork without calendar information.

These options are inadequate. They cannot accommodate the diverse sizes of artwork used for pictorial calendars. They are impractical for the number of pages typical for pictorial calendars. They require too much space for storage or display. Nor are they easily retrofitable for existing expired pictorial calendars.

The disclosed invention overcomes the deficiencies of the other options by permitting reuse of pictorial calendar artwork as renewed pictorial calendars.

The limited choice in artwork is another problem related to conventional pictorial calendars. Calendar themes such as animals, famous people, cars, etc. are published annually from which customers can choose. But no methods exist for conveniently converting one's own artwork into pictorial calendars that are reusable for multiple years. Limited solutions are available. For example, combination calendars and picture frames exist. Personally selected artwork can be put into the frame, and the calendar information is replaceable. However, only one item of artwork is held in the frame and replacing the artwork can be tedious. Alternatively, personally selected artwork can be printed with calendar information. But, here again, the problem of reusing the artwork remains.

The present invention will solve this problem. The invention allows personal photograph albums or any other personal artwork to be converted into pictorial calendars that can be reused for as many years as the artwork will last. In essence, a truly personal pictorial calendar is obtainable with this invention; each photograph can be personally selected and reused repeatedly.

OBJECTS AND ADVANTAGES

Accordingly, several objects and advantages of this invention are:

- The invention permits pictorial calendar fabrication from any bound printed artwork.
- The invention allows unsold, expired pictorial calendars to be sold and used in future calendars.
- The invention allows artwork from expired pictorial calendars to be reused repeatedly with unexpired calendar information.
- The invention can result in a pictorial calendar that is specifically designed for repeated use.
- The invention can allow the artwork for pictorial calendars to be sold separately from the calendar information.
- The invention can allow conversion of personal photograph albums into pictorial calendars.
- The invention, by reusing artwork, can reduce the amount of artwork that is disposed of each year. This yields a reduced need for disposal or recycling of high ink content paper. The paper generated as a result of the invention will be easier to recycle than printed artwork.

Still further objects and advantages will become apparent from a consideration of the ensuing description and drawings.

DRAWING FIGURES

REFERENCE NUMERALS IN DRAWINGS

Figure 1:
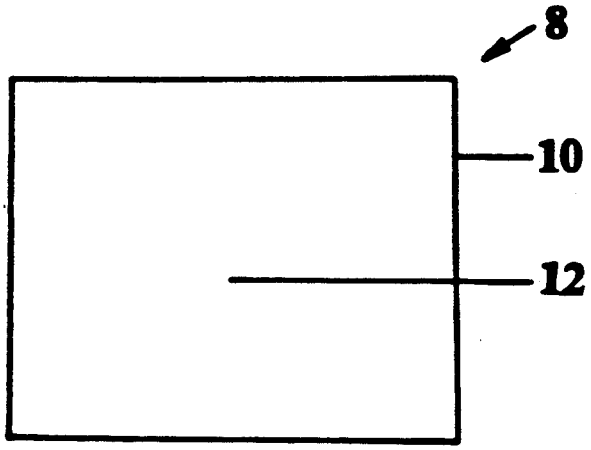
FIG. 1 shows a front view of a calendar sticker.

8 calendar sticker
10 sheet
12 unexpired calendar information
14 adhesive
16 page
18 artwork
20 binding
22 undesired printing
30 bound book

DETAIL DESCRIPTION OF INVENTION

FIG. 1 shows a calendar sticker 8. It comprises a sheet 10 that is substantially opaque, flexible, and planar. Sheet 10 can be made of any material suitable for printing such as paper, cloth, plastic, or metal. One side of sheet 10 shows unexpired calendar information 12. Calendar information 12 can be printed on the front of sheet 10 or applied by any other appropriate process. The format of unexpired calendar information 12 can be the same as that typically used for existing pictorial calendars. Alternatively, any other desired format can be used. Other than calendar information can be printed in addition to unexpired calendar information 12. The other than calendar information may include text information, personal data, useful facts, advertisements, quotes, jokes, or inspiring notes.

Figure 2:
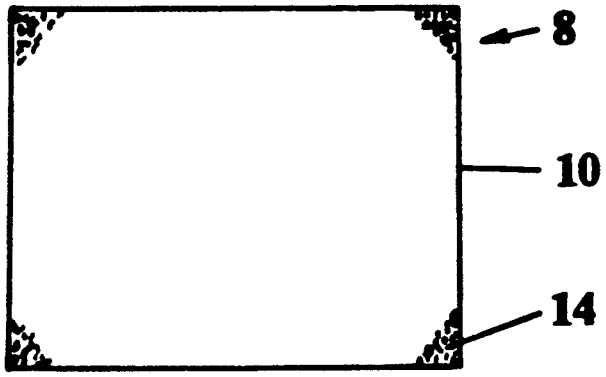
FIG. 2 shows a back view of the calendar sticker.

A back view of calendar sticker 8 appears in FIG. 2. Areas of or all of the back side of sheet 10 can be covered with an adhesive 14. In FIG. 2, adhesive 14 is only present at the corners of sheet 10. The amount, type, or placement pattern of adhesive 14 are irrelevant, provided adhesive 14 serves as a means for attaching sheet 10 to a surface. Examples of the types of adhesives that can be used are permanent adhesives, removable adhesives, water activated adhesives, organic solvent activated adhesives, and adhesives with peel away protective backing. Any practical method can be used to apply adhesive 14 to areas of sheet 10.

Figure 3:
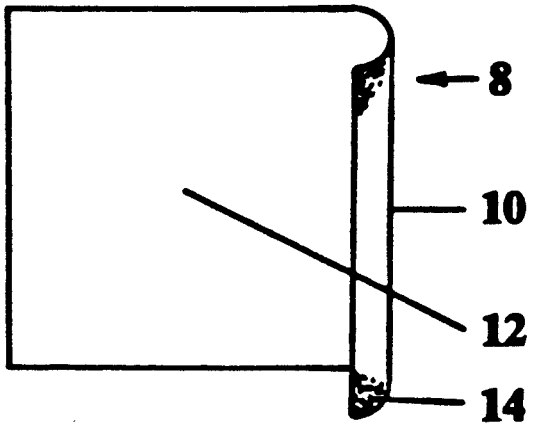
FIG. 3 shows a perspective view of the calendar sticker partially folded.

FIG. 3 shows how sheet 10, unexpired calendar information 12, and adhesive 14 are combined to form calendar sticker 8. Calendar sticker 8 is partially folded in FIG. 3 so part of unexpired calendar information 12 and some of adhesive 14 are visible simultaneously.

Figure 4:
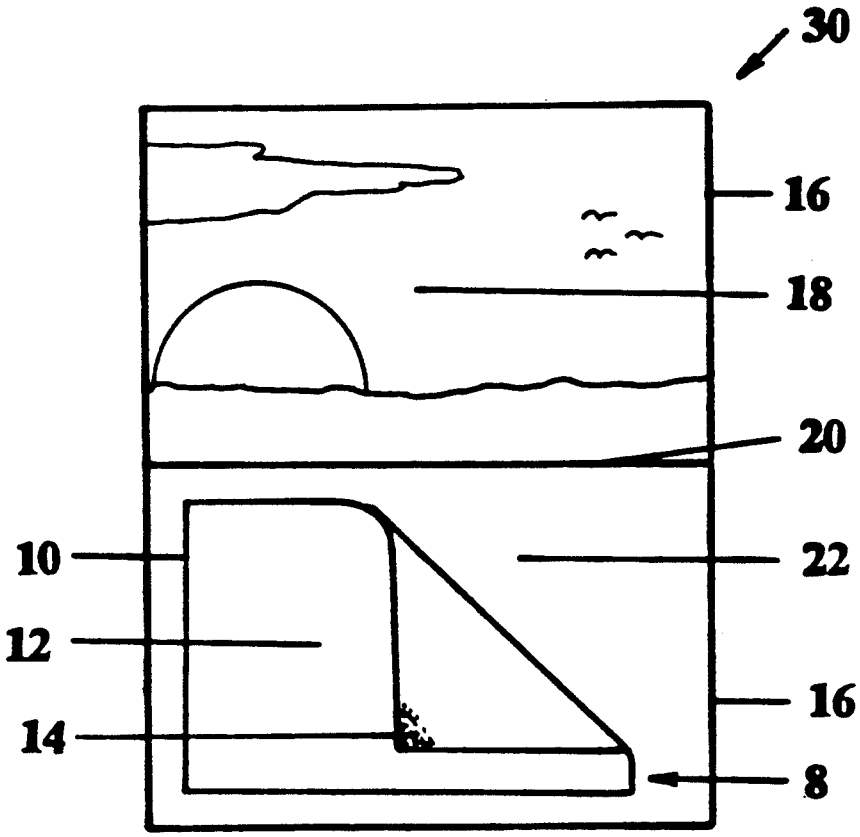
FIG. 4 shows the calendar sticker partially applied to a page in a bound book.

FIG. 4 shows a bound book 30 containing a plurality of pages 16. Pages 16 are bound together along one edge with a binding 20. Binding 20 can be of any type such as staples, glue, stitching, or spiral binding. Pages 16 may have desirable artwork 18 to be view in conjunction with unexpired calendar information 12 on sheet 10. Pages 16 may also contain undesired printing 22 that is not to be displayed with unexpired calendar information 12. For instance, undesired printing 22 may be expired calendar information when bound book 30 comprises an expired pictorial calendar. Alternatively, bound book 30 can be a photograph album that may contain personally selected photographs. Or, bound book 30 can be a book containing artwork or pictures as in a picture book.

FIG. 4 also shows calendar sticker 8 partially applied to one page 16 in bound book 30. Calendar sticker 8 can be used to cover undesired printing 22 such as expired calendar information. Sheet 10 is partially attached to one page 16 with adhesive 14. Some of, as yet, unused adhesive 14 is shown in FIG. 4.

Figure 5:
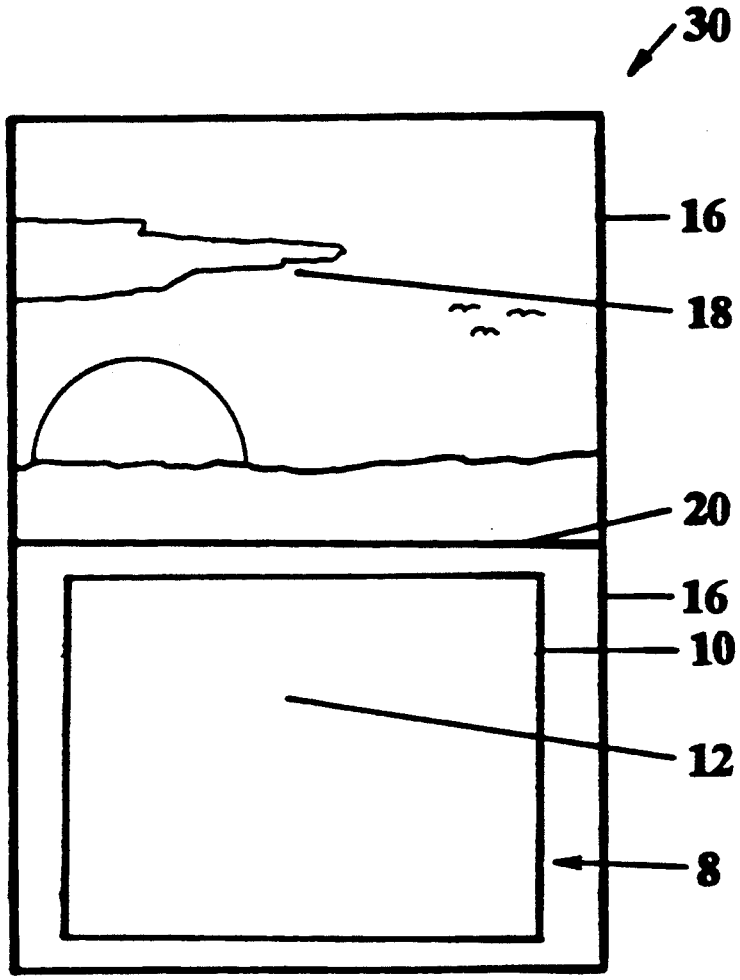
FIG. 5 shows the calendar sticker fully applied to the bound book, yielding an unexpired calendar suitable for future use.

FIG. 5 shows a complete, usable, pictorial calendar. Sheet 10 with unexpired calendar information 12 is completely attached by adhesive 14, not shown in this figure, to page 16 in bound book 30. A second page 16, that faces the front of sheet 10, shows desirable artwork 18. The result is a display of unexpired calendar information 12 and desirable artwork 18 in a format typical of pictorial calendars. Calendar sticker 8 can also serve to cover undesired printing 22 on page 16 to which calendar sticker 8 is attached.

Figure 6:
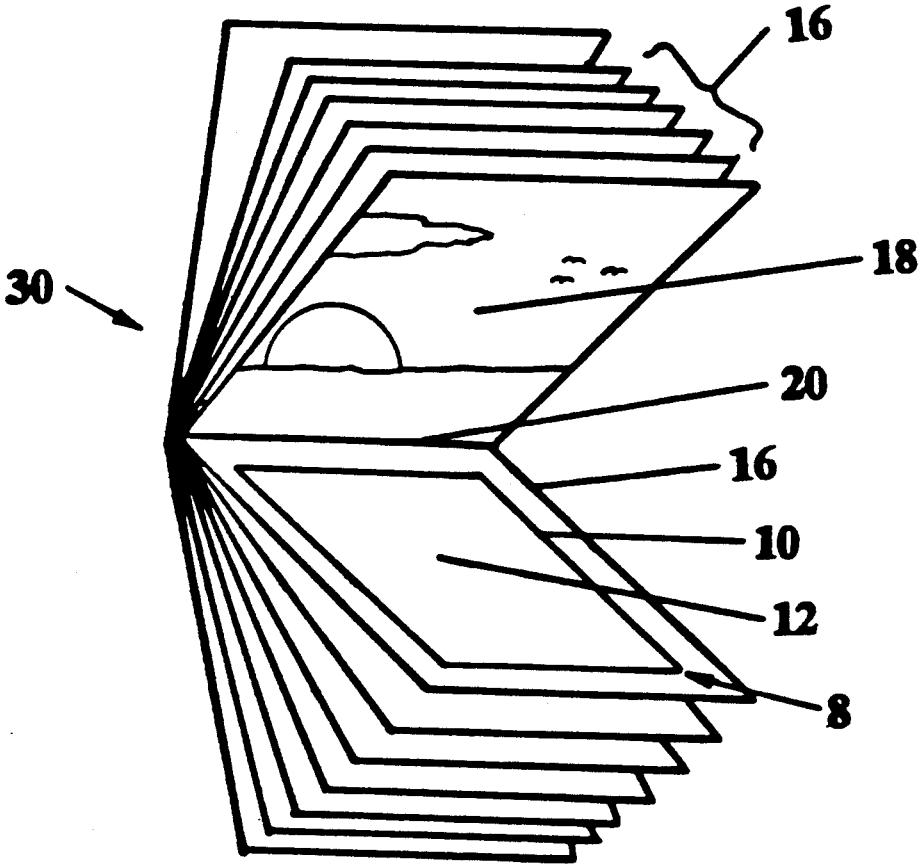
FIG. 6 shows a perspective view of the calendar sticker applied to the bound book.

FIG. 6 presents a perspective view of the invention. Bound book 30 is shown having a plurality of pages 16 held together with binding 20. Calendar sticker 8 is shown attached to page 16 and additional pages 16 are shown with artwork 18.

EXAMPLES

Fabrication procedures for two preferred embodiments of this invention are given in the examples below.

EXAMPLE 1

An example of the disclosed invention was made using an expired pictorial calendar and calendar stickers. The expired pictorial calendar was printed by Landmark General Inc. for use in 1990. The theme for the calendar was Bicycles. The calendar presented a different photograph of bicyclists for each month of the year. Each photograph was printed on a page facing another page displaying calendar information for the month. The pages, 12.75" wide and 9.75" long, were bound together with staples. The photographs and calendar information were oriented in a landscape format with the photograph above the calendar information when displayed.

Calendar stickers were made from twelve sheets of paper, 12.75"×9.75". Each sheet was printed with calendar information for one of the months from July 1991 to June 1992. The calendar sticker fabrication was completed by applying adhesive with protective paper backing to the back of the sheets. The adhesive was SCOTCH TM Brand Adhesive Transfer Tape Number 924, produced by 3M Inc. The protective paper backing on the adhesive simplifies handling of the calendar stickers. A hole was punched in each of the calendar stickers to correspond to the hole in the pictorial calendar for mounting.

The protective backing paper was removed from the adhesive for the July 1991 sticker. The adhesive was then used to attach the sticker to the page having calendar information for January 1990. This procedure was repeated for each calendar sticker to cover all pages of expired calendar information. The final result was a pictorial calendar showing a separate photograph with calendar information for each month from July 1991 to June 1992.

EXAMPLE 2

A personal photograph album was converted into a reusable pictorial calendar using the disclosed invention. The photograph album was composed of four 8"×10" photographs. The photographs were mounted onto four sections of 11"×11" card-stock paper. The photographs and mounting sections were then laminated with plastic, 10 mils thick. The photographs were bound with metal spiral binding. This resulted in a four page personal photograph album.

The calendar stickers for this example were produced using the same procedure as described in Example 1. But for this example, the calendar stickers were 11"×11" and made for the months July 1991 to October 1991.

A calendar sticker was applied to the back of each of the mounted laminated photographs. The result was a pictorial calendar displaying a different photograph with current calendar information for four months of the year. Holes punched in the pages allow hanging the calendar on a wall.

The plastic lamination increases the useful life of the photographs, protecting them from tears and scratches. The lamination also facilitates removal and replacement of the calendar stickers.

SUMMARY, RAMIFICATIONS, AND SCOPE

Clearly, the described invention is useful and convenient for producing and updating pictorial calendars. Using this invention, artwork from expired pictorial calendars can be made into updated pictorial calendars to be enjoyed again and again. One can reuse one's favorite pictorial calendar. There is no need to print or reprint artwork for new pictorial calendars; only the calendar information needs to be printed when this invention is used. Consequently, reuse of the artwork will reduce the amount of high ink-content paper that is disposed of or recycled. This advantage is particularly beneficial for pictorial calendars for which the area of the artwork is many times larger than the area of the calendar information. In such cases, using small calendar stickers allows reuse of large areas of artwork.

This invention also permits virtually any person to design a personal pictorial calendar. The person can select the artwork, decide the arrangement of the artwork, then fabricate the pictorial calendar. The artwork can be from a personal photograph album or from almost any source of bound artwork. The person can have high quality artwork printed with less concern about cost of the artwork because the artwork can be reused for multiple years. Efforts to increase the durability of the artwork, such as plastic lamination, can also be used with less worry about added cost, because the artwork is reusable.

Furthermore, this invention allows pictorial calendars to be marketed in a new way. Traditionally, pictorial calendars are sold with the calendar information printed on the same side or on the back side of the pages with the artwork. However, this invention allows the artwork and calendar information to be sold separately. That is, the bound pages of artwork can be sold, or resold or reused in any year; meanwhile, new calendar stickers can be sold each year. Thus, reuse and resale of the artwork becomes effective and profitable. Also, the artwork can be made to easily accommodate applying and removing the calendar stickers by using surface treatments of the artwork pages. Artwork can be specifically designed for multiple year use as part of a pictorial calendar.

While the above description contains many specificities, these should not be construed as limitations on the scope of the invention, but rather as an exemplification of preferred embodiments thereof. Many other variations are possible. For example, the calendar stickers can be bound together instead of having the artwork bound. Then sheets having the artwork would be attached to bound pages of calendar information to obtain the standard pictorial calendar format. This new embodiment may have the adhesive on the back side or the front side of the calendar stickers, depending on how the artwork and calendar information are to be displayed. In another embodiment, the sheet used for the calendar sticker can have areas with weakened lines of attachment to the main sheet. The weakened lines can be created by perforating the sheet with lines of holes as is commonly used for paper with tear-away sections. The weakened lines would serve to ease separation of the areas. The adhesive would be applied to areas with the weakened attachment; this arrangement could simplify separation of the adhesive from the bulk of the calendar sticker for recycling. Accordingly, the scope of the invention should be determined not by the embodiments illustrated, but by the appended claims and their legal equivalents.

What is claimed is:

1. In a combination a pictorial calendar, having artwork and expired calendar information printed thereupon, and calendar stickers adherent to the pictorial calendar and covering the expired calendar information, the calendar stickers being substantially opaque, the front of the calendar stickers having printed thereupon unexpired calendar information, the calendar stickers having an adhesive on the back surface for attachment to the pictorial calendar, whereby users can observe the unexpired calendar information on the calendar stickers and the artwork on the pictorial calendar.

2. In a combination a book having a plurality of pages bound together along one edge, at least one of the pages having artwork printed thereupon, and calendar stickers, the calendar stickers being adherent to at least one of the pages and covering an area of at least one of the pages of the book, the calendar stickers being substantially opaque, the front of the calendar stickers having printed thereupon unexpired calendar information, the calendar stickers having an adhesive on the back surface for attachment to the pages, whereby users can observe the unexpired calendar information on at least one of the calendar stickers and the artwork on at least one of the pages of the book.

3. The invention of claim 2 wherein alternating pages of the book have artwork and the calendar stickers are attached to the pages opposite the artwork.

4. The invention of claim 2 having the calendar sticker attached to the page containing artwork such that substantial portions of the artwork are uncovered by the calendar sticker.

* * * * *